United States Patent [19]

Gomez Harlow

[11] Patent Number: 4,679,343

[45] Date of Patent: Jul. 14, 1987

[54] 4 PLUS DOUBLE LOADER

[76] Inventor: James B. Gomez Harlow, 7560 E. Juniper Dr., Tucson, Ariz. 85730

[21] Appl. No.: 830,322

[22] Filed: Feb. 14, 1986

[51] Int. Cl.[4] ..... F41C 27/00; F42B 39/00

[52] U.S. Cl. ..... 42/87

[58] Field of Search ..... 42/87, 88

[56] References Cited

U.S. PATENT DOCUMENTS

| | | | |
|---|---|---|---|
| 863,798 | 8/1907 | Hodges | 42/87 |
| 1,874,408 | 8/1932 | Zichy | 42/87 |

FOREIGN PATENT DOCUMENTS

| | | | |
|---|---|---|---|
| 2440535 | 7/1980 | France | 42/87 |
| 4884 | of 1903 | United Kingdom | 42/87 |
| 22583 | of 1912 | United Kingdom | 42/87 |

*Primary Examiner*—Charles T. Jordan

[57] ABSTRACT

A loading device for double barreled firearms. The device comprises a universal ring member, shell holders and a stabilizer bar for the quick reloading of double barrel firearms.

1 Claim, 2 Drawing Figures

4 PLUS DOUBLE LOADER

BACKGROUND OF THE INVENTION

The invention relates to a loading device for a double barrel firearm, either an over and under or side by side shotgun or rifle.

SUMMARY

The object of the invention is to provide a sure and quick reload of a double barrel firearm. Two shells are carried on the back side of the forward hand on a universal ring for quick release into the firearm chambers.

DESCRIPTION OF THE PREFERRED EMBODIMENT

Figure 2:
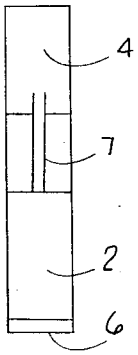
FIG. 2 is a side view of the device of FIG. 1.
Figure 1:
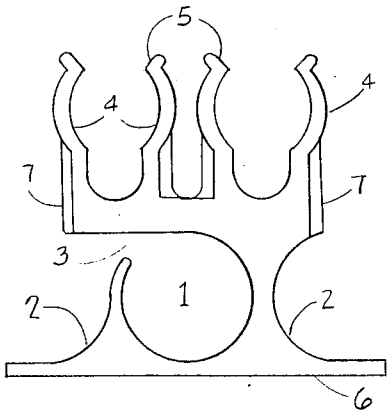
FIG. 1 is a perspective view of the loading device.

The loader device comprises a universal ring 1 to be worn on the middle finger and having an open segment 3 in order to be adjustable to different finger thicknesses. The ring 1 has a stabilizer bar, which keeps the loader from tilting, and grip surfaces 2. The loader has two flexible shell holders 4 attached to ring 1 by a body portion 7 for holding a range of shells of different sizes, for example, 28 gauge to 12 gauge for shotguns. The shell holders 4 have lips 5 for easy acceptance of shells inserted therein. The loader can be made of Polyurethane, or similar plastic by injection molding or employ metal spring clamps.

In operation the universal ring 1 is placed on the middle finger with the shell holders 4 on the back side of the user's hand and the stabilizer bar 6 across the inside of the hand, and when the firearm is to be reloaded the barrels are pivoted open and with a twist of the user's wrist the shells are inserted in the barrel's chambers and the holders pulled away leaving the shells in the chambers.

The loader can also be modified to hold two sets of shells and have means for carrying the loader on a belt.

What is claimed is:

1. An integral one-piece molded plastic loading device for double barreled firearms comprising: a universal ring member, a plurality of shell holders, and a stabilizer bar; said ring member having an open segment therein for adjustably fitting about a user's middle finger; said shell holders being positioned on the back side of a user's hand and having guide lips for the acceptance and guiding of shells therein, and said stabilizer bar extending across the inside of said user's hand to prevent tilting of said device during loading of the firearm.

* * * * *